United States Patent [19]

Walker

[11] Patent Number: 4,673,186

[45] Date of Patent: Jun. 16, 1987

[54] OUTDOOR GAME AND APPARATUS

[75] Inventor: William J. Walker, Spokane, Wash.

[73] Assignee: Walker Enterprises, Inc., Townsend, Mont.

[21] Appl. No.: 839,546

[22] Filed: Mar. 14, 1986

[51] Int. Cl.[4] ..... A63B 67/12; A63B 65/12

[52] U.S. Cl. ..... 273/399

[58] Field of Search ..... 273/398–400, 273/67 R, 68, 83, 327

[56] References Cited

U.S. PATENT DOCUMENTS

| | | | |
|---|---|---|---|
| 712,159 | 10/1902 | Voege | 273/400 |
| 1,116,554 | 11/1914 | Boggis | 273/400 |
| 1,208,235 | 12/1916 | Thayer | 273/400 |
| 1,419,554 | 6/1922 | Ganse | 273/400 |
| 1,505,609 | 8/1924 | Seeman et al. | 273/68 |
| 3,348,846 | 10/1967 | Atchison | 273/400 X |
| 3,467,388 | 9/1969 | Weiler | 273/400 X |
| 3,970,307 | 7/1976 | Breglia | 273/399 |
| 4,145,048 | 3/1979 | Basil | 273/400 |

FOREIGN PATENT DOCUMENTS

| | | | |
|---|---|---|---|
| 623873 | 7/1961 | Canada | 273/327 |
| 470791 | 6/1914 | France | 273/327 |
| 345488 | 3/1931 | United Kingdom | 273/398 |

*Primary Examiner*—Paul E. Shapiro

*Attorney, Agent, or Firm*—William D. West

[57] ABSTRACT

An outdoor game and associated apparatus having a plurality of goals, playing balls with holes drilled therein, and tapered elongate shooting sticks used for projecting the balls toward the goals is disclosed. The goals are buckets or mesh baskets elevated above ground level by a ring having a standard projecting therefrom which is insertable into the ground. The playing balls are spherical wooden balls having holes drilled therein. One hole runs through the center of the ball and is open on either end, whereas the second hole is drilled substantially normal and off-center to the first hole. The elongate tapered shooting stick is provided with a grip end and a cylindrical tip end which can be inserted in the holes in the playing balls and is used by a player to project the balls toward the goals by use of an underhand throwing motion. A method of play is also disclosed.

10 Claims, 7 Drawing Figures

OUTDOOR GAME AND APPARATUS

BACKGROUND OF THE INVENTION

1. Field of the Invention

The invention relates to an outdoor game and its associated apparatus and in particular to an outdoor game in which a ball is propelled by the use of a stick into a series of baskets.

2. Discussion of the Technical Problems

Most currently played lawn games and outdoor games for home use seem to be variations of badminton, croquet or horseshoes. Of course, established courses are available for golf and tennis; however, other than the previously mentioned games, very few games exist for outdoor recreation which can be played in one's back yard. Of the available games, the skill level needed to play the game varies and no known outdoor game for home use allows players of all ages and skill levels to participate equally. A game is needed which may be played by as few as two people and by all age groups from very small up to mature adults.

The game should be inexpensive and easy to set up and take down so that it could be removed during times of inclement weather. It should be of simple construction, easily stored, and the rules should be not overly complex so that people can play the game for relaxation and recreation. The instant invention is directed to all these needs as well as to others as explained in the following summary.

SUMMARY OF THE INVENTION

It is a feature of the invention to provide an outdoor game.

It is another feature of the instant invention to provide an inexpensive outdoor game which can readily be mastered by players of all ages.

It is another feature of the instant invention to provide an outdoor game having player-operated elongate shooters which propel playing balls toward baskets in an organized fashion.

It is another feature of the instant invention to provide an outdoor game which is adaptable to varying terrains.

These and other features and objects are attained according to the instant invention by providing an outdoor game having elongate wooden shooters which have tapered ends fitting into apertures in wooden spherical playing balls so that the ball may be fitted on the end of the elongate shooting stick and propelled toward targets. The targets are baskets or buckets which are elevated and placed according to the terrain in which the game is to be played. The players shoot the ball by inserting the tip of the elongate shooting rod into one of the drilled holes in the ball. The playing ball is provided with a centered hole as well as an off-centered hole. The centered hole allows for a non-rotating arc of the ball whereas the off-centered hole provides a lofting, high arcing shot having backspin. The shooting motion is an underhand movement which allows the ball to slide freely off of the elongate rod. The object of the game is to use the fewest possible shots to complete the course.

BRIEF DESCRIPTION OF THE DRAWINGS

The advantages of this invention will become apparent upon consideration of the following detailed disclosure of the invention, especially when taken in conjunction with the accompanying drawings, wherein.

DESCRIPTION OF THE PREFERRED EMBODIMENT

Figure 1:
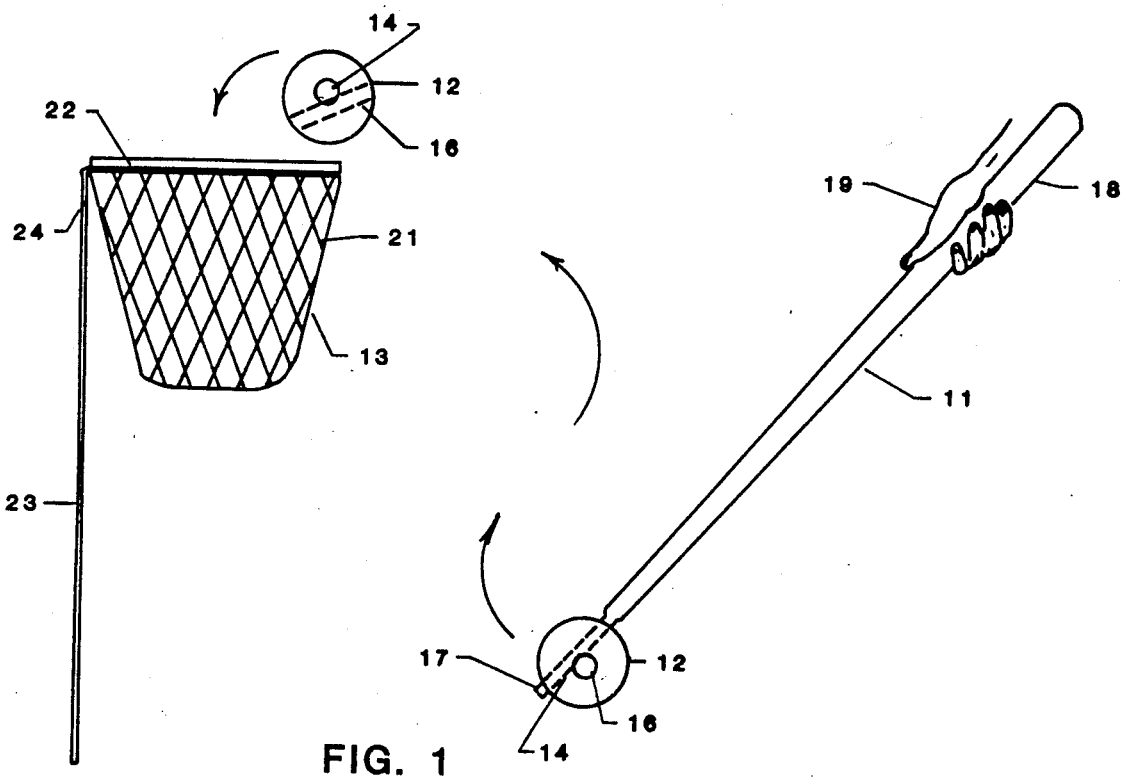
FIG. 1 is a side elevational view of the elongate shooting stick with a depiction of a playing ball slideably attached to the tip of the stick. A second playing ball is depicted rotating in an arc toward the basket in accordance with the instant invention.

The apparatus of the instant invention is depicted generally in FIG. 1. As can be seen by reference to FIG. 1, the apparatus utilizes a shooting stick (11), a playing ball (12), and a goal basket (13). Playing ball (12) is a spherical ball made of wood or any other suitable material and is provided with two holes. There is provided both a center hole (14) and an off-center hole (16). The shooting stick (11) is generally an elongate tapered rod having a narrowed tip portion (17) and a handle portion (18). The handle portion (18) may be gripped by the hand of the player (19) in either an overhand or underhand position; however, it is contemplated that the use of the shooter stick (11) will be made by a player in an underhand motion such as used in pitching horseshoes or throwing a ball in an underhand manner. The tip (17) of shooter stick (11) is cylindrical and is inserted into either center hole (14) or off-center hole (16) of playing ball (12). By inserting the shooting stick tip (17) into the center hole, the ball is lofted in a straightforward, non-spinning manner whereas if tip (17) is inserted into off-center hole (16), a spin is imparted to the ball in a back direction which aids in stopping the ball if the ball does not rest in basket goal (13).

Basket goal (13) is any suitable container or basket which can be used as a goal; however, in the preferred embodiment, a mesh basket (21) is provided which is elevated and supported by a top ring (22) and stand (23). Stand (23) can be inserted into the ground (not shown). Stand (23) could be of a single-piece construction with supporting ring (22) or it could be threadably engaged to ring (22) at joint (24) in a manner well known in the art for joining segmented rods.

Figure 2:
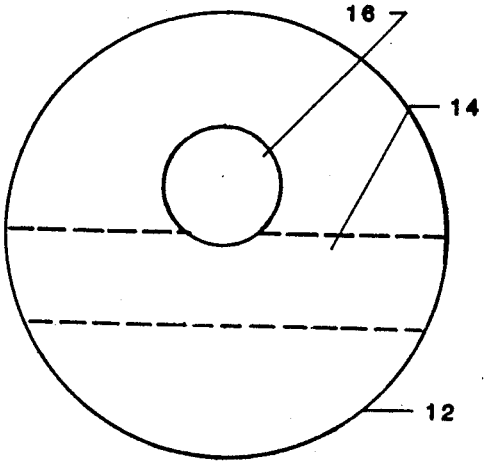
FIG. 2 is a top plan elevational view of a playing ball in which the off-centered hole is shown at the top and the centered hole is shown by dashed lines substantially normal to the off-centered hole.
Figure 3:
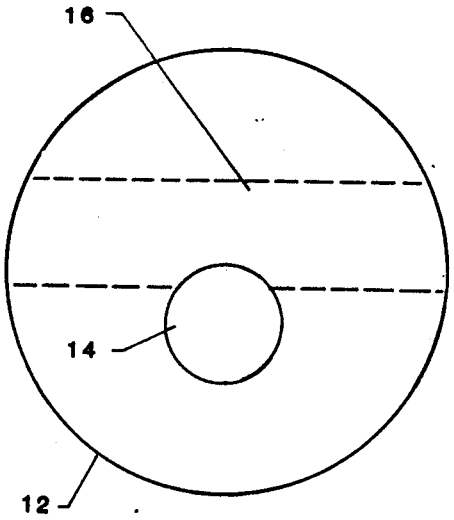
FIG. 3 is a front elevational view of the playing ball in which the centered hole is shown in the center of the ball and the off-centered hole is shown by dashed lines.

Referring to FIGS. 2 and 3 where the construction of the playing ball is depicted, it will be noted that the spherical ball (12) is provided with a pair of holes (14 and 16) which extend through the ball in two locations. The center hole (14) is substantially through the center of the sphere (12) and off-center hole (16) is approximately 90 degrees to center hole (14) yet does not go through the center of the ball but above or below center hole (14).

Figure 4:
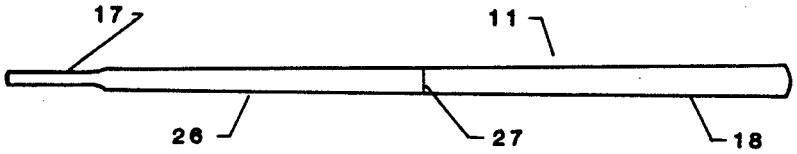
FIG. 4 is a right side elevational view of the tapered elongate shooting stick in which it is shown that it can be joined in two pieces.

Referring to FIG. 4 where shooting stick (11) is depicted, it can be seen that stick (11) is an elongate rod being tapered from the grip end (18) toward the tip portion (26) and that tip (17) is necked down so that tip (17) is substantially cylindrical and will fit in either center hole (14) or off-center hole (16) in playing ball (12). Shooting stick (11) is made of wood but any suitable material could be used such as metal or plastic. If it is necessary to break down shooting stick (11), shooting stick (11) can be provided with a threadable connection at point (27) so that grip portion (18) will unscrew from narrower portion (26) for easier portability of the shooting stick (11). Shooting stick (11) in the first embodiment resembles a tapered pool cue without a cushion on the tip and is provided with a necked down portion (17) to be inserted into playing ball (12).

Figure 5:
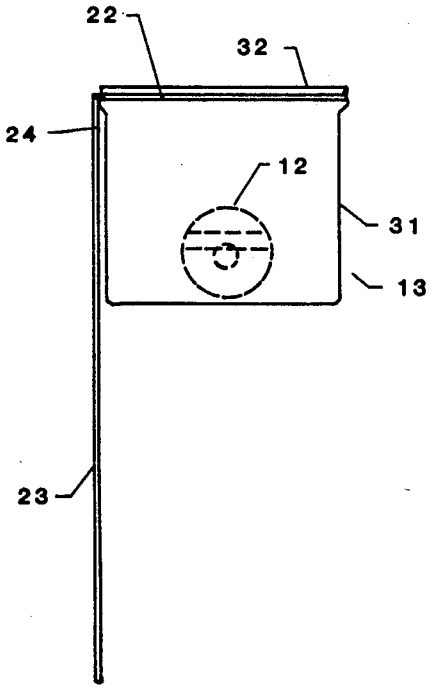
FIG. 5 is a right side elevational view of the bucket type of goal in which a playing ball is shown in dashed lines in accordance with the instant invention.
Figure 6:
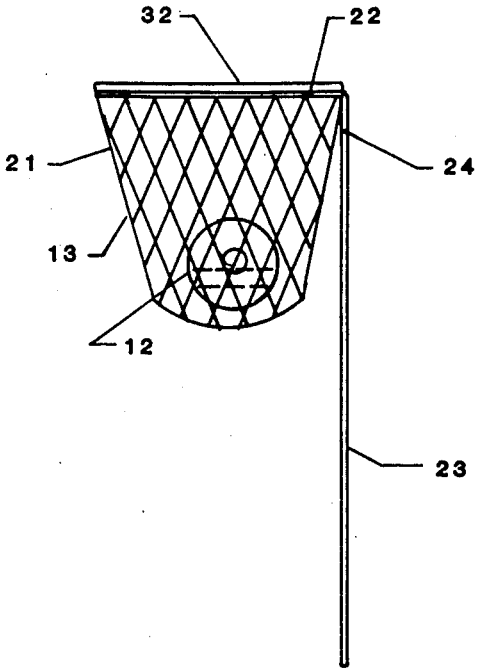
FIG. 6 is a left side elevational view of a mesh basket goal having a playing ball disposed within.

FIGS. 5 and 6 depict goals (13) of different types and the type in FIG. 5 is a bucket (31) such as made of polystyrene or similar material in which playing ball (12) will fit. Mesh (21) can also be used as a basket for goal (13) to keep playing ball (12) cradled when ball (12) is tossed into the open portion (32) of either type of goal (13). Both types of goal are provided with a standard (23) which is attached to an upper ring portion (22) at connection point (24). Standard (23) and upper ring portion (22) could be of a single piece or could be joined as depicted in FIGS. 5 and 6.

The playing of the game of the instant invention will now be described with reference to FIG. 7 in which goals (13) are arranged in a random pattern as appropriate for the particular terrain. In the preferred embodiment, four goals numbered 1, 2, 3, and 4 are depicted and a circle (in dashed lines) surrounding the goals (41) is shown. The diameter of the circle (41) is the distance from the goal (13) equal to two lengths of shooting stick (11). The inside of circle (41) is known as the "scratch zone" in the play of the game. A hazard such as a bush (42) is depicted on the lower portion of FIG. 7. The hazard (42) must be dealt with by the players in the actual playing of the game by lofting the ball (12) over or around the hazard (42).

The playing of the game involves selecting a course which is best suitable to the players' abilities. The goals or baskets (13) may be placed around natural hazards such as trees, bushes (42), hillsides, and the like. The distances between goals (13) can be quite lengthy or could be relatively short as shown in FIG. 7. The distances between the baskets can be varied, depending on how difficult one wishes to make the playing of the game.

A normal or regulation game would consist of two trips around the four-basket course which would equal eight baskets made by each player.

It is possible to modify the game by playing the game on a course designed with only two or three baskets if the terrain or obstructions were necessary to shorten the size of the course.

In order to begin play, it is necessary that the players decide on the placement of each goal or basket (13). The players then determine in which sequence the baskets or goals (13) will be played. The baskets are then designated sequentially such as depicted in FIG. 7, one through four.

Figure 7:
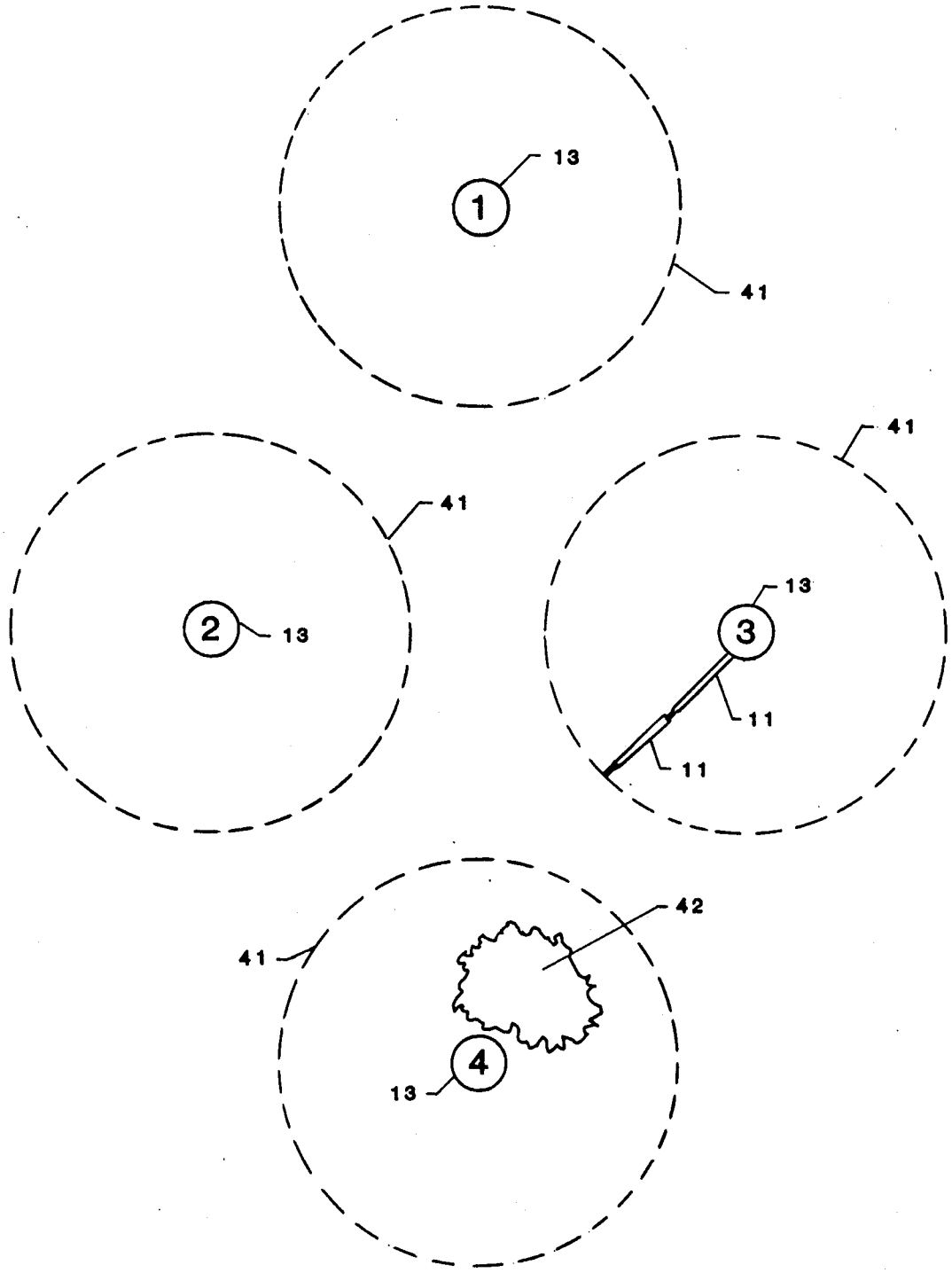
FIG. 7 is a top plan view of a representative course for the playing of the outdoor game of the instant invention.

After the course as depicted in FIG. 7 is set up and the sequence of the basket goals (13) is determined, each player selects a shooter (11) and a ball (12). It is contemplated that for four players there would be four different colored balls, although the construction of each ball (12) would be as previously described. The players then determine the order in which the players will shoot; that is, who will be first, second, and third. The shooting sequence remains the same throughout the entire game. The first player begins at a designated or predetermined starting place and inserts tip end (17) of shooting stick (11) into either center hole (14) or off-center hole (16) in ball (12). Then, by pitching the shooting stick and ball in an underhand manner, tries to place the ball in goal (13), designated #1 in FIG. 7. Each player then in turn makes a shot toward the first goal (13). No player may attempt a second shot until all players have completed the first shot. The players then continue to shoot or toss their own playing balls (12) in turn toward basket goal (13) which was designated the first basket. If a ball (12) lands within the distance of the "scratch zone" (41) within two shooter rods (11) from the goal, the player must remove the ball to the outside of scratch zone (41) and away from the intended goal (13). Moving the ball out of the scratch zone counts as a shot in the scoring. As each player tosses a ball, it is necessary that that player count the number of shots that are made. Play continues to goal (13) designated as the second basket only after each player has managed to eventually toss his ball (12) into the first goal.

The players can toss the ball or shoot the ball by inserting tip (17) of the shooter into one of the predrilled holes in the ball. In normal practice, the use of the center hole produces a controlled, low arcing shot; whereby using the off-centered hole (16), a lofting, high shot is produced.

Each player must shoot the ball (12) from where it lands, the only exception being when a ball lands within scratch zone (41). In that case, the ball must be removed from the scratch zone (41) and an additional shot is counted against the player for having removed the ball from the scratch zone. If a player steps within the scratch zone while shooting at the basket, that shot does not count.

As previously mentioned, the object of the game of the instant invention is to complete the course using the fewest possible shots. Each player should count the number of shots that it takes to successfully make each basket in a manner similar to the scoring of golf. The scores are marked on a score card prior to proceeding to the next basket goal (13). After the completion of the course, each player then totals his individual shot count. The player with the fewest possible shots would ordinarily be the winner unless a handicap was declared in a manner similar to golf.

For additional interest in the game, a procedure known as the "eight ball" is provided. When all players have successfully completed the last basket goal, each player then is given the option of shooting his ball (the eighth ball) from a distance of four shooter lengths from the last basket goal. Only one eight-ball shot per player is allowed. If a player makes the eight-ball shot, he is allowed to deduct three points from his total score. If a player chooses to shoot the eight ball and misses the shot, he automatically loses the game. The player with the highest total score is allowed to shoot the eight ball first, followed by the player with the next highest score and so on, finishing with the player with the lowest score total. Whether or not to shoot the eight ball is optional for any player except if the scores are tied for first place. In the event of a tie for first place, the tying players must shoot the eight ball to determine the winner.

Although specific materials, dimensions, components, proportions, and methods have been stated in the above description of the preferred embodiments of the invention, other suitable materials, proportions, process steps as listed herein may be used with satisfactory results and varying degrees of quality. In addition, it will be understood that various other changes in details, materials, steps, arrangements of parts, and uses which have been herein described and illustrated in order to explain the nature of the invention will occur to, and may be made by those skilled in the art, upon a careful reading of this disclosure, and such changes are intended to be included within the principles and scope of this invention as hereinafter claimed.

I claim:

1. An outdoor game apparatus comprising:

(a) An elongate rod having a gripping end and a tip end;

(b) A projectile having at least one substantially centered aperture therein and an off-center aperture with a longitudinal axis substantially normal to the longitudinal axis of said center aperture wherein said tip end of said elongate rod is adaptable to being inserted in either of said apertures in said projectile; and (c) A goal at which the projectile is targeted.

2. The outdoor game apparatus as described in claim 1 wherein said projectile is a spherically shaped ball.

3. The outdoor game apparatus as described in claim 2 wherein each of said apertures extends all the way through the ball.

4. The outdoor game apparatus as described in claim 1 wherein said elongate rod is comprised of two segments.

5. The outdoor game apparatus as described in claim 4 wherein said elongate rod is of a smaller diameter at the tip end than at said grip end.

6. The outdoor game apparatus as described in claim 1 wherein said goal is comprised of a horizontally disposed ring elevated above the ground.

7. The outdoor game apparatus as described in claim 6 further comprising a mesh basket depending from said ring.

8. The outdoor game apparatus as described in claim 6 further comprising a bucket depending from said ring.

9. A method of playing an outdoor game, the method comprising the steps of:

(a) providing a number of players an equal number of elongate rods having a gripping end and a tip end;

(b) providing said players a like number of spherically shaped balls having at least one substantially centered aperture therein and an off-center aperture with a longitudinally axis substantially normal to the longitudinal axis of said centered aperture, each of which said apertures are adaptable to having said elongate rod inserted therein;

(c) providing a plurality of goals arranged in an organized manner;

(d) selectively tossing said projectile by use of said elongate rod at said goals;

(e) scoring the number of attempts at shooting the projectile at the goals; and (f) determining the outcome of the game by the lowest number of attempted shots.

10. The method for playing an outdoor game as described in claim 9 further comprising the step of repeating the same sequence of steps through the number of goals.

* * * * *